US006945172B1

(12) United States Patent
Shih

(10) Patent No.: US 6,945,172 B1
(45) Date of Patent: Sep. 20, 2005

(54) HOUSING ASSEMBLY FOR A SELF-INKING STAMP

(76) Inventor: Shiny Shih, No. 31, Lane 349, Chungcheng S. Rd., Yungkang City, Tainan Hsien (TW)

( * ) Notice: Subject to any disclaimer, the term of this patent is extended or adjusted under 35 U.S.C. 154(b) by 0 days.

(21) Appl. No.: 10/864,455

(22) Filed: Jun. 10, 2004

(51) Int. Cl.[7] ..... B41K 1/42; B41J 21/00

(52) U.S. Cl. ..... 101/333; 101/103; 101/104; 101/405

(58) Field of Search ..... 101/333, 103, 101/104, 108, 405

(56) References Cited

U.S. PATENT DOCUMENTS

| | | | | | |
|---|---|---|---|---|---|
| 2,947,243 | A * | 8/1960 | McKnight | 101/28 |
| 5,850,787 | A * | 12/1998 | Pichler | 101/105 |
| D421,452 | S * | 3/2000 | Pichler | D18/15 |
| 6,302,022 | B1 * | 10/2001 | Shih | 101/379 |
| D493,191 | S * | 7/2004 | Sculler et al. | D18/15 |
| 6,761,114 | B2 * | 7/2004 | Koneczny et al. | 101/333 |
| 2003/0150343 | A1 * | 8/2003 | Koneczny | 101/333 |

FOREIGN PATENT DOCUMENTS

| | | | | |
|---|---|---|---|---|
| JP | 09240123 A | * | 9/1997 | B41K 1/00 |
| JP | 10119402 A | * | 5/1998 | B41K 1/00 |

* cited by examiner

*Primary Examiner*—Daniel J. Colilla
*Assistant Examiner*—Marvin P. Crenshaw
(74) *Attorney, Agent, or Firm*—Hershkovitz & Associates; Abe Hershkovitz

(57) ABSTRACT

A housing assembly for a self-inking stamp includes a movable case, two pressing keepers and a protective film. The movable case has two opposite sides and two keeper mounting holes respectively defined through the sides of the movable case and aligned with each other. The pressing keepers are respectively and retractably mounted in the keeper mounting holes. The protective film is attached to the movable case and has two covering areas respectively aligned with and covering the pressing keepers. Consequently, the pressing keepers are completely enclosed and covered by the protective film, which will prevent gaps around the pressing keepers from being caulked or clogged with the contaminants as dust, skin oil or ink. In addition, the protective film will provide an improved touching feeling when a person holds the self-inking stamp.

6 Claims, 6 Drawing Sheets

HOUSING ASSEMBLY FOR A SELF-INKING STAMP

BACKGROUND OF THE INVENTION

1. Field of the Invention

The present invention relates to a housing assembly for a self-inking stamp, and more particularly to a housing assembly for a self-inking stamp wherein the housing assembly comprises an outside protective film to render the entire housing assembly clean and neat.

2. Description of Related Art

Self-inking stamps, such as business address stamps are convenient to print identical messages on different surfaces. With reference to FIG. 6, a conventional self-inking stamp comprises a stationary case (60), an ink pad (61), a printing pad (62), a housing assembly (63) and a restitution element (64).

The stationary case (60) has a top, two opposite sides, a front, two elongated slots (601), two upper detents (602), two lower detents (603) and an ink pad hole (604). The elongated slots (601) are longitudinally defined in the respective sides. The upper detents (602) are respectively defined in the sides over the corresponding elongated slot (601), and each of them has a bottom inclined edge (605). The lower detents (603) are respectively defined in the sides, overlap the corresponding elongated slot (601), and each of them has a bottom inclined edge (606). The ink pad hole (604) is defined in the front at a height above the lower detents (603).

The ink pad (61) is removably mounted and held in the stationary case (60) through the ink pad hole (604), contains ink and has a bottom onto which the printing pad (62) is in contact.

The printing pad (62) is movably and rotatably mounted in the stationary case (60), comprises two sliding studs (621) and has a printing face (622). The sliding studs (621) are slidably held in the respective elongated slots (601) and extend out of the corresponding elongated slot (601). The printing face (622) is usually in contact with the bottom of the ink pad (61) but is pushed down away from the ink pad (61) and rotated 180 degrees to print.

The housing assembly (63) is slidably mounted on the stationary base (60) and comprises a movable case (632) and two pressing keepers (631). The movable case (632) is slidably mounted on the stationary case (60) onto which the extended sliding studs (621) are coupled to so that the movable case (632) moves the printing pad (61).

The pressing keepers (631) are retractably mounted on the movable case (632) and are respectively aligned with the elongated slots (601). Each of the pressing keepers (631) has an engaging device (633) including multiple nubs (634) to engage with either the upper or the lower detents (602, 603) to maintain the movable case (632) at one of two given heights relative to the stationary case (60).

The restitution element (64) is a spring and is mounted on the top of the stationary case (60) in the movable case (632) to return the movable case (632).

A person can press both the pressing keepers (631) inward to the movable case (632) to engage the lower detents (603) to maintain the movable case (632) at a height corresponding to the lower detents (603) to keep the printing face (622) from contacting with the ink pad (61) when the stamp is not in use. If the person presses the movable case (632) downward, the nubs (634) on the pressing keepers (631) will disengage from the lower detents (603) through the bottom inclined edges (606) of the lower detents (603), which permits the movable case (632) to be completely pressed downward to move the printing pad (62) to print.

The person can press both the pressing keepers (631) inward the to the movable case (632) to engage the upper detents (602) to maintain the movable case (632) at a height corresponding to the upper detents (602) so that replacing the ink pad (61) is practical. Likewise, the person presses the movable case (632) downward, whereby the nubs (634) on the pressing keepers (631) will disengage from the upper detents (602) through the bottom inclined edges (605) of the upper detents (602) when the replacement of the ink pad (61) is completed.

However, the entire stamp is not neat because of the extending pressing keepers (631). The pressing keepers (631) extending solely at respective sides of the movable case (632) will cause the entire stamp to be unsightly and unattractive.

Furthermore, contaminants such as dust, skin oil or ink may caulk gaps around the pressing keepers (631), which will propagate bacteria. To completely clean the contaminants from the gaps around the pressing keepers (631) is difficult unless disassembling the pressing keepers (631) off from the movable case (632). Thus, the stamp will become dirty after a long-term use.

To overcome the shortcomings, the present invention provides a housing assembly comprising a protective film that covers and encloses pressing keepers to mitigate or obviate the aforementioned problems.

SUMMARY OF THE INVENTION

The main objective of the invention is to provide a housing assembly for a self-inking stamp, and the housing assembly comprises a movable case with two retractable pressing keepers, and a protective film that covers the pressing keepers to render the entire self-inking stamp clean and neat.

The housing assembly for a self-inking stamp in accordance with the present invention includes a movable case, two pressing keepers and a protective film. The movable case has two opposite sides and two keeper mounting holes respectively defined through the sides of the movable case and aligned with each other. The pressing keepers are respectively and movably mounted in the keeper mounting holes. The protective film is attached to the movable case and has two covering areas respectively aligned with and covering the pressing keepers. Consequently, the pressing keepers are completely enclosed and covered by the protective film, which will prevent gaps around the pressing keepers from being caulked or clogged with the contaminants as dust, skin oil or ink. In addition, the protective film will provide an improved touching feeling when a person holds the self-inking stamp.

Other objectives, advantages and novel features of the invention will become more apparent from the following detailed description when taken in conjunction with the accompanying drawings.

DETAILED DESCRIPTION OF PREFERRED EMBODIMENT

Figure 1:
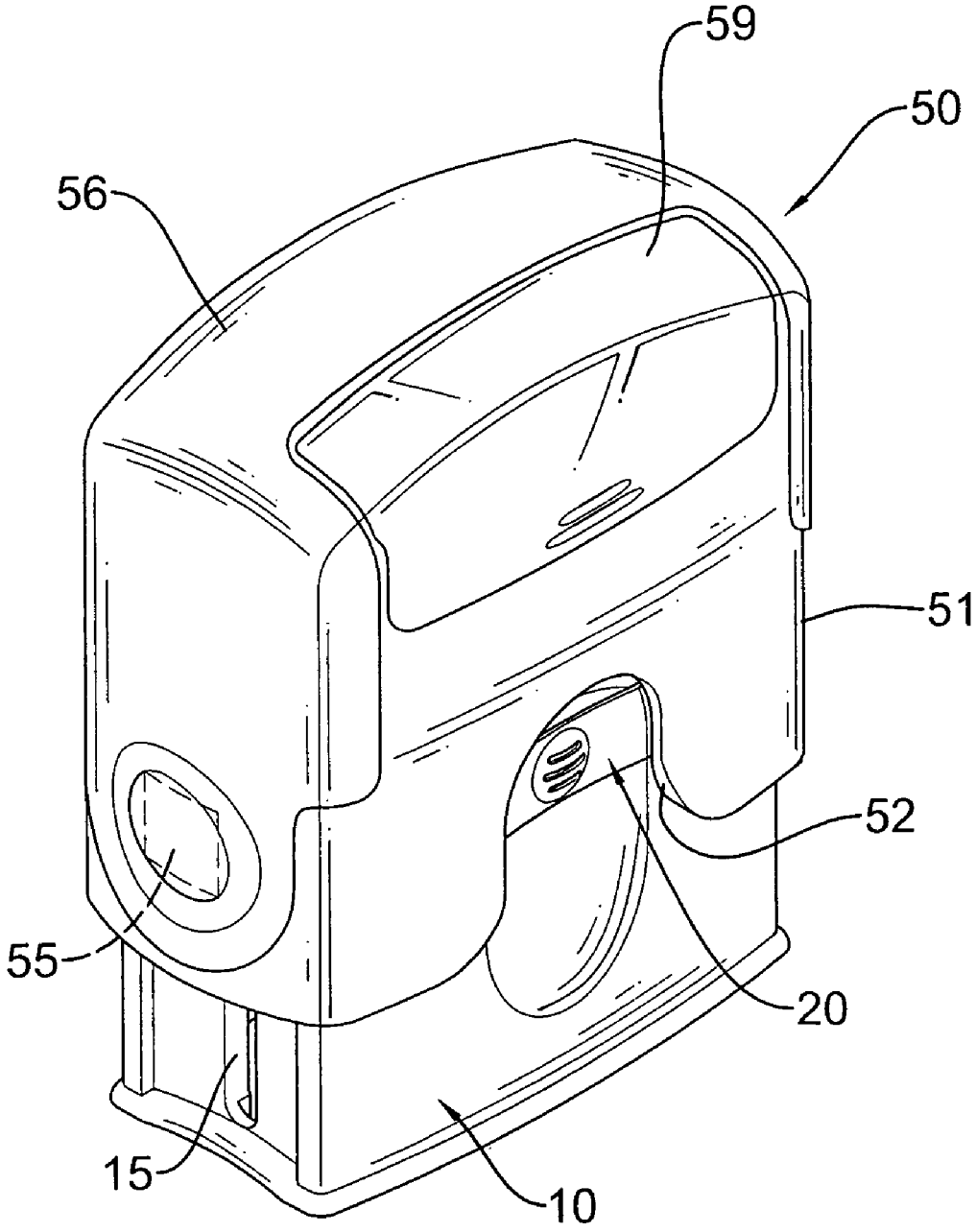
FIG. 1 is a perspective view of a self-inking stamp with a housing assembly in accordance with the present invention.
Figure 2:
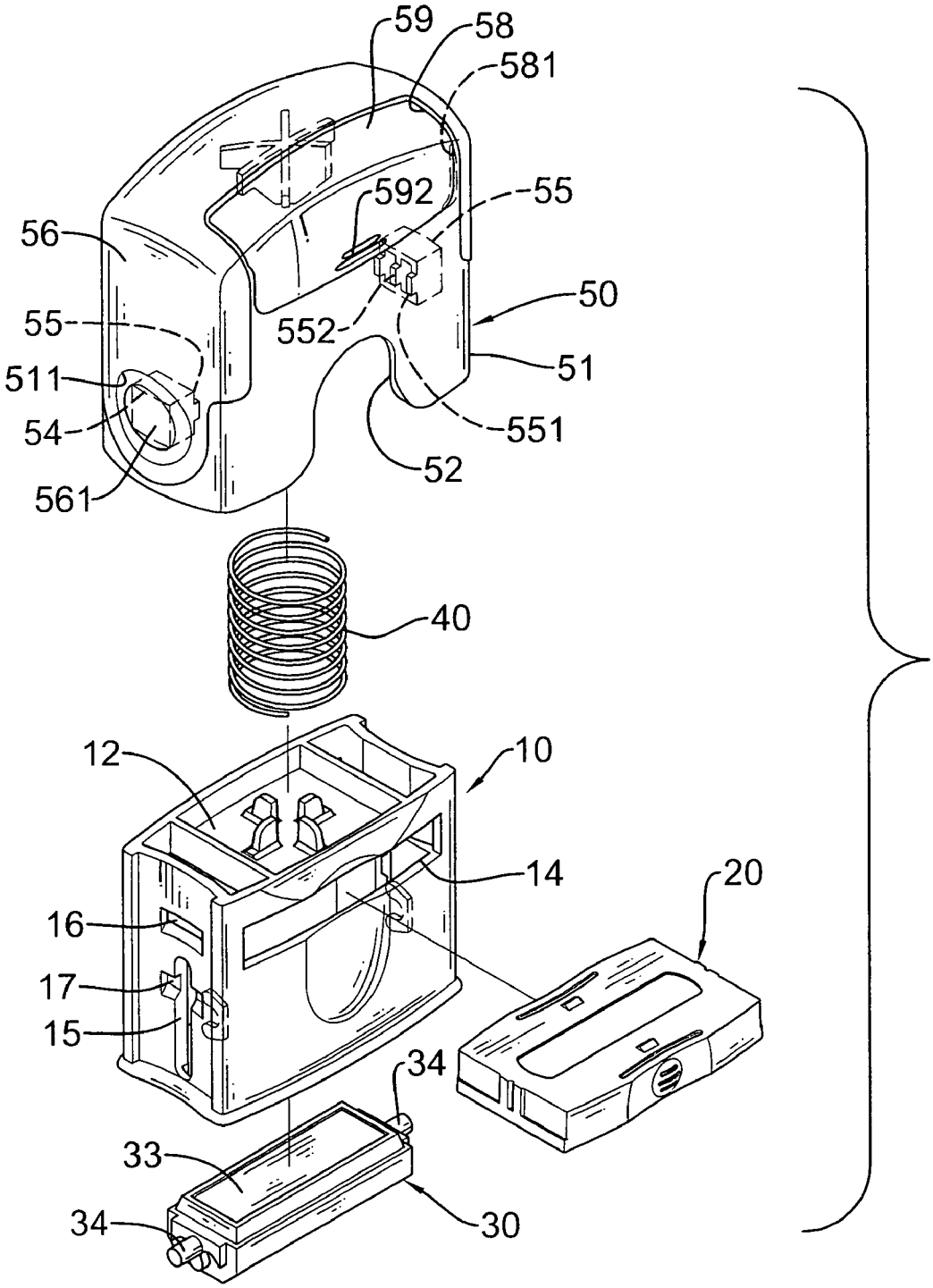
FIG. 2 is an exploded perspective view of the self-inking stamp in FIG. 1.

With reference to FIGS. 1 and 2, a self-inking stamp comprises a stationary case (10), an ink pad (20), a printing pad (30), a housing assembly (50) and a restitution element (40).

The stationary case (10) has a top (12), two opposite sides, two elongated slots (15), two upper detents (16), two lower detents (17) and an ink pad hole (14). The elongated slots (15) are completely defined through the sides of the stationary case (10) and are aligned with each other. The upper detents (16) are respectively defined in the sides over the corresponding elongated slots (15). The lower detents (17) are respectively defined in the sides of the stationary case (10) and overlap the corresponding elongated slots (15). The ink pad hole (14) is defined between the sides of the stationary case (10).

The printing pad (30) is slidably and rotatably mounted in the stationary case (10) along the elongated slots (15) and has two sliding studs (34). The sliding studs (34) are respectively and slidably held in the elongated slots (15) and extend out of the elongated slots (15).

The ink pad (20) is held in the stationary case (10) through the ink pad hole (14) to contain ink and can be replaced with a new one if the ink is exhausted.

The housing assembly (50) in accordance with the present invention is mounted on the stationary case (10) and comprises a movable case (51), two pressing keepers (55), a protective film (56) and a transparent cover (59).

Figure 3:
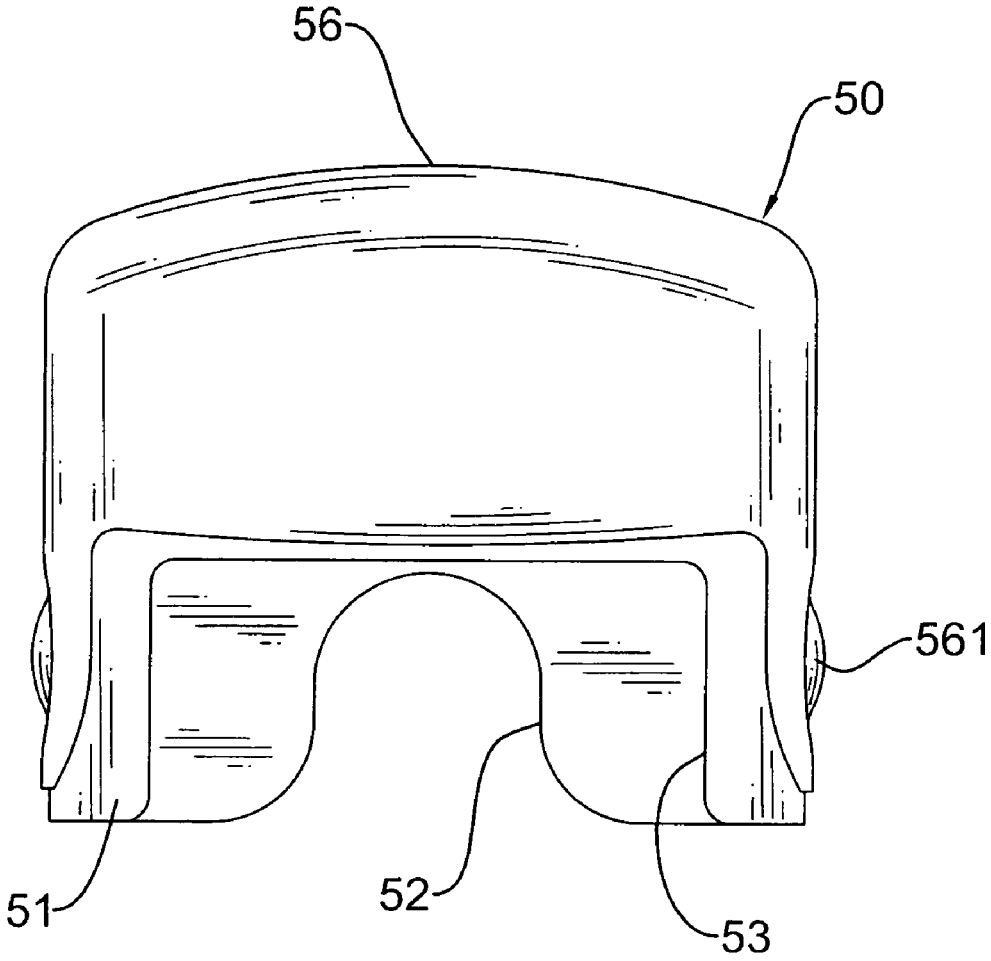
FIG. 3 is a rear perspective view of the housing assembly.

With further reference to FIG. 3, the movable case (51) is slidably mounted on the stationary case (10) and has a front, a rear, a top, two opposite sides, two skirt recesses (511), a front recess (52), a rear recess (53), two keeper mounting holes (54) and a cover opening (58).

The front recess (52) is defined through the front and has a hemispheric shape. The rear recess (53) is defined through the rear, is aligned with the front recess (52) and has a rectangular shape. The keeper mounting holes (54) are respectively defined through the sides of the movable case (51) and are aligned with each other. The skirt recesses (511) are respectively defined in the sides of the movable case (51) around the mounting holes (54) onto which the protective film (56) is adhered. The cover opening (58) is defined in a corner between the front and the top of the movable case (51) and has two opposite sides. Two longitudinal slots (581) are respectively defined at the sides of the cover opening (58) through which the transparent cover (58) is inserted into and held in the cover opening (58). A paper note can be held inside the transparent case (58) to indicate the message corresponding to the printing pad (30).

The pressing keepers (55) are respectively and movably mounted in the keeper mounting holes (54), and each of them comprises two engaging nubs (551) and a central guiding nub (552). The central guiding nub (552) is defined between the engaging nubs (551) and slides in and along a corresponding elongated slot (15). The engaging nubs (551) engage either the upper or the lower detents (16, 17) when the pressing keepers (55) are pressed inward in the movable case (51).

Figure 4:
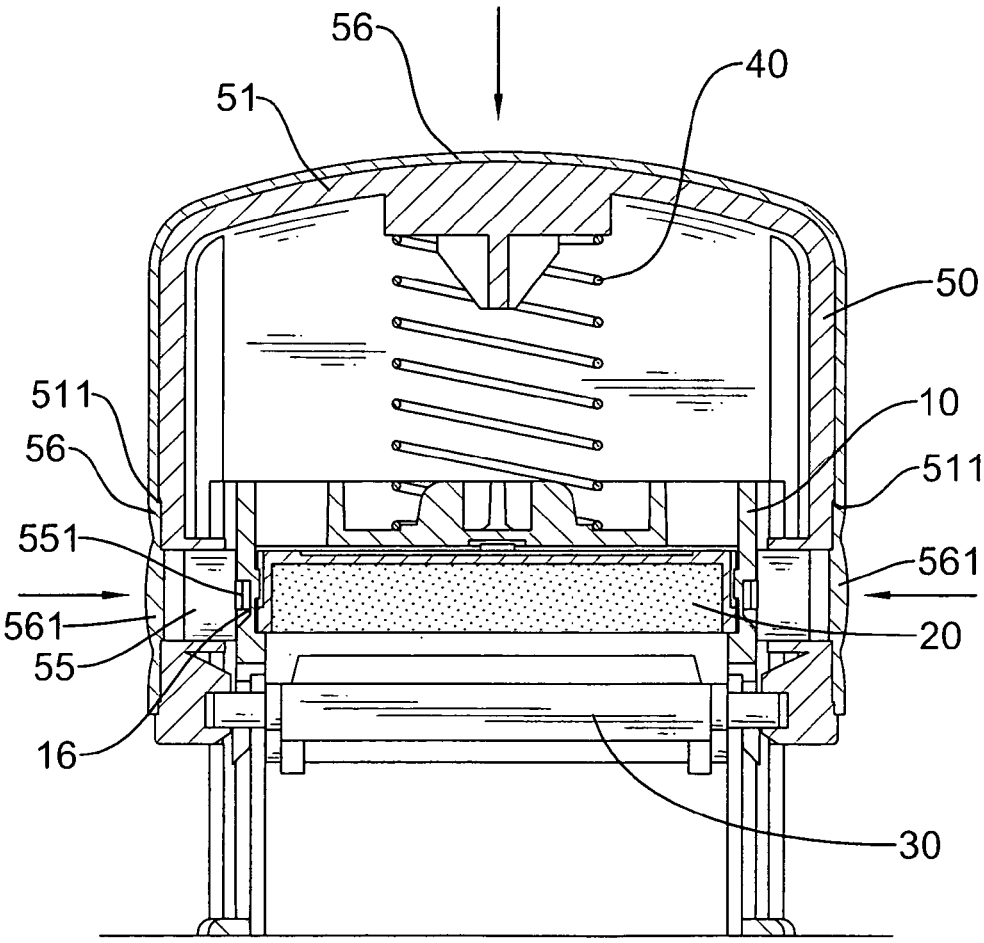
FIG. 4 is a front elevation view of the self-inking stamp in partial section in FIG. 1.
Figure 5:
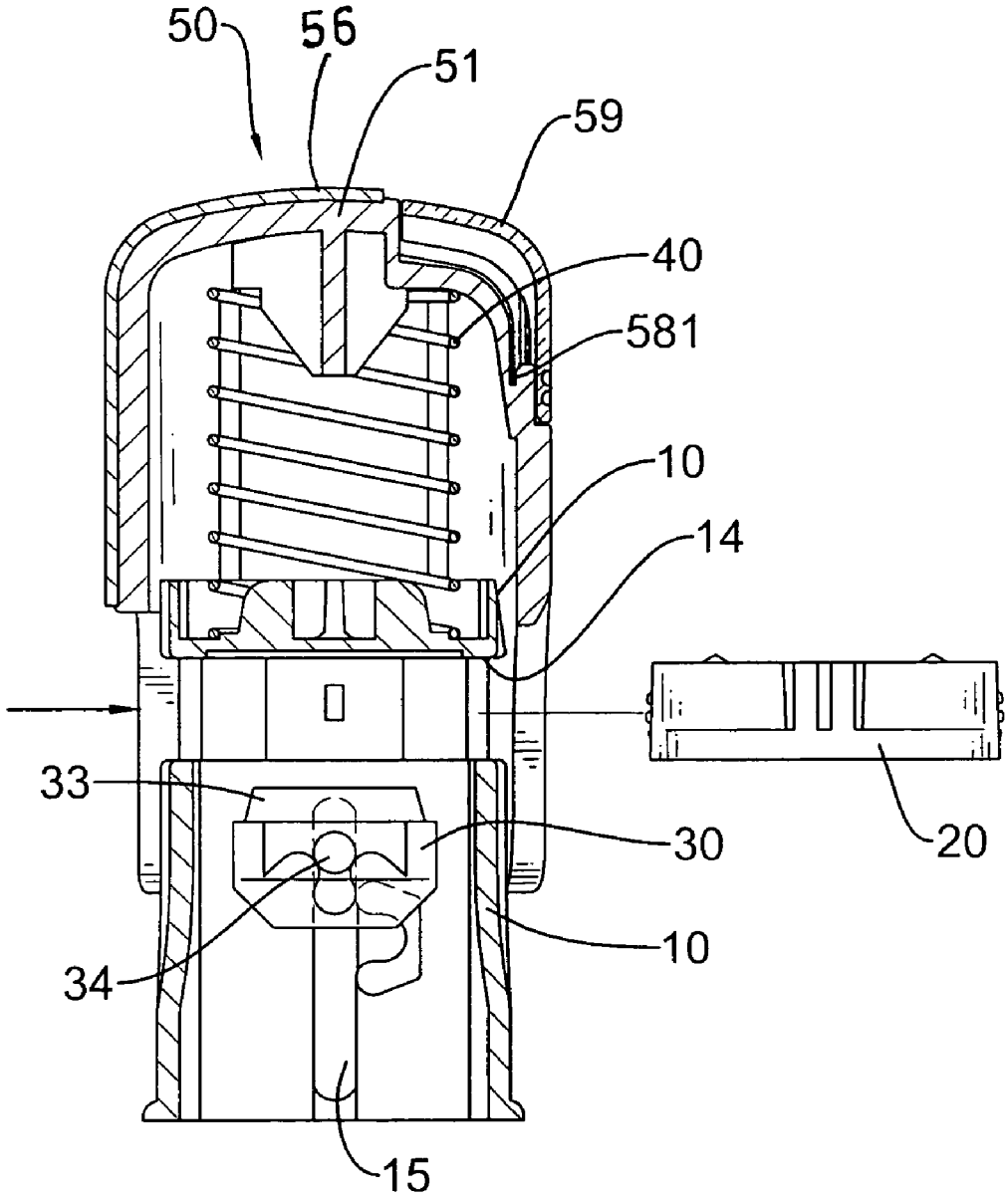
FIG. 5 is an operational side elevation view on the self-inking stamp in FIG. 1 when replacing an ink pad.
Figure 6:
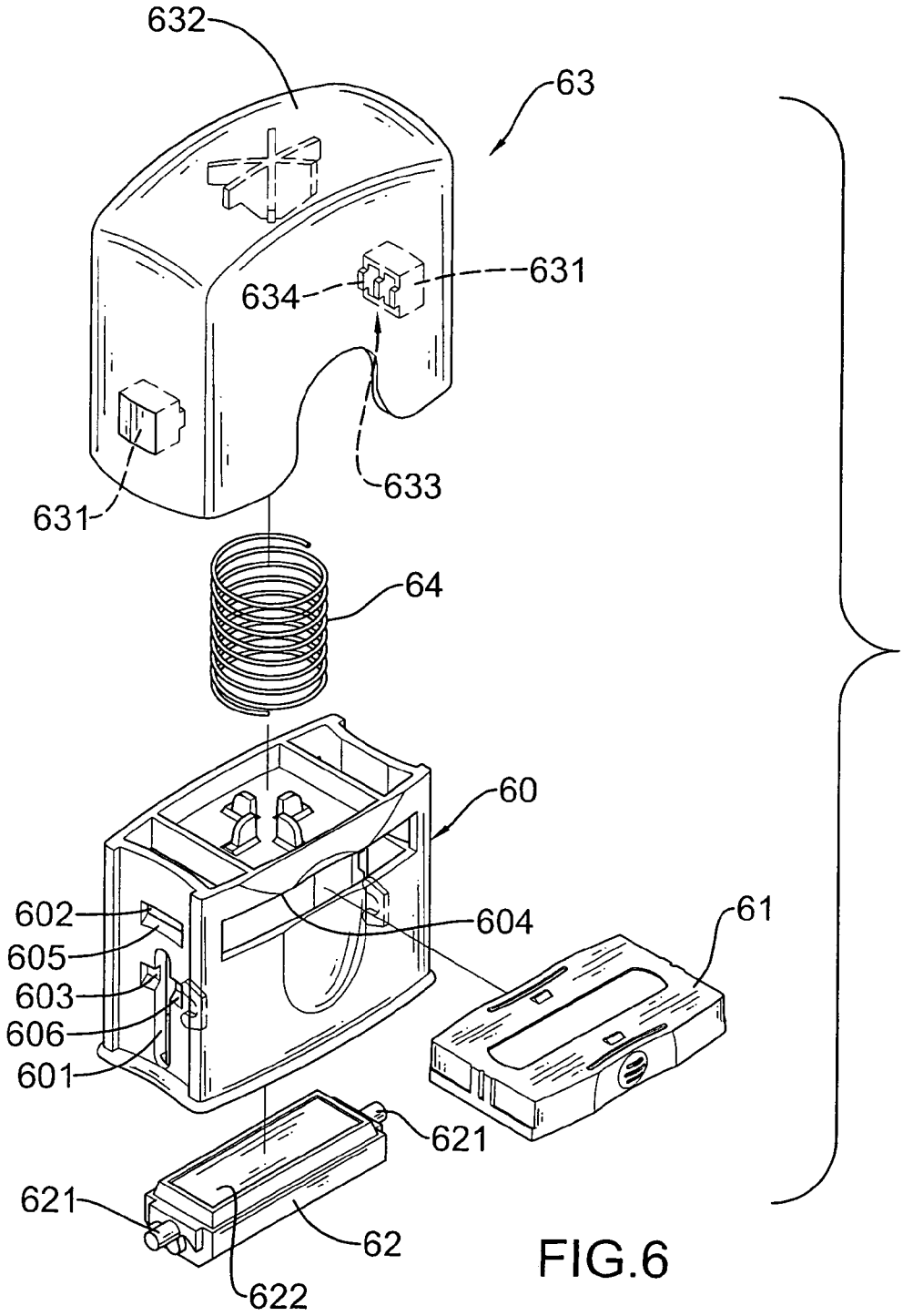
FIG.6 PRIOR ART
FIG. 6 is an exploded perspective view of a conventional self-inking stamp in accordance with the prior art.

With reference to FIGS. 4 and 5, the protective film (56) is attached to the movable case (51) and has two covering areas (561). The covering areas (561) are respectively aligned with the pressing keepers (55) to cover and enclose the pressing keepers (55), are respectively held in the skirt recesses (511), and each of them has a solid concave shape. A person can press the covering areas (561) to slide the pressing keepers (55) inward the movable case (51) to render the engaging nubs (551) engaging either the upper detents (16) or the lower detents (17). Therefore, the movable case (51) will be maintained at a given height on the stationary case (10) so that replacing the ink pad (20) is available and convenient.

With reference to FIGS. 2 and 5, the transparent cover (59) is held the cover opening (58) on the movable case (51) by inserting the transparent cover (58) into the longitudinal slots (581). The transparent cover (59) comprises a textured area (592) including multiple grooves to prevent the movable case (51) from slipping easily out of hands when a person holds and presses the movable case (51) to stamp something.

The restitution element (40) is a spring, is mounted on the top (12) of the stationary case (10) inside the movable case (51) to push the movable case (51) upward when the pressed movable case (51) is released.

Consequently, the pressing keepers (55) are completely enclosed and covered by the protective film (56), which will prevent gaps around the pressing keepers (55) from being caulked or clogged with the contaminants such as dust, skin oil or ink. In addition, the protective film (56) will provide an improved touching feeling when a person holds the self-inking stamp.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A housing assembly for a self-inking stamp, and the housing assembly comprising; a self-inking stamp;

a movable case having a front, a rear, a top, two opposite sides and two keeper mounting holes respectively defined through the sides of the movable case and aligned with each other;

two pressing keepers respectively and retractably mounted in the keeper mounting holes; and a protective film attached to the movable case and having two covering areas respectively aligned with and covering the pressing keepers.

2. The housing assembly for a self-inking stamp as claimed in claim 1, wherein each of the covering areas has a solid concave shape.

3. The housing assembly for a self-inking stamp as claimed in claim 1, wherein the movable case further has two skirt recesses respectively defined in the sides of the movable case around the keeper mounting holes.

4. The housing assembly for a self-inking stamp as claimed in claim 1, wherein each of the pressing keepers comprises multiple engaging nubs and a central guiding nub extending inward the movable case.

5. The housing assembly for a self-inking stamp as claimed in claim 1, further comprising a transparent cover mounted on the movable case;

wherein, the movable case further has a cover opening with two opposite sides defined in the front and the top of the movable case; and two longitudinal slots respectively defined at the sides of the cover opening through which the transparent cover is inserted.

6. The housing assembly for a self-inking stamp as claimed in claim 5, wherein the transparent cover further has a textured area.

* * * * *